United States Patent [19]

Leonard, Jr. et al.

[11] 4,241,971

[45] Dec. 30, 1980

[54] PIGTAIL ASSEMBLY

[75] Inventors: Robert D. Leonard, Jr., Poland; Charles R. Nestor, Niles, both of Ohio

[73] Assignee: General Motors Corporation, Detroit, Mich.

[21] Appl. No.: 72,089

[22] Filed: Sep. 4, 1979

[51] Int. Cl.[3] ..... H01R 13/44

[52] U.S. Cl. ..... 339/116 C; 339/182 R

[58] Field of Search ..... 339/26, 177 R, 177 E, 339/182 R, 182 RS, 183, 148, 116 R, 116 C; 338/28, 34, 229

[56] References Cited

U.S. PATENT DOCUMENTS

| | | | |
|---|---|---|---|
| 1,762,848 | 6/1930 | Whisler | 339/258 C |
| 2,108,635 | 2/1938 | Aiken et al. | 123/169 |
| 2,271,507 | 1/1942 | Mantz | 339/177 R |
| 2,690,541 | 9/1954 | Elliott | 339/26 |
| 2,743,428 | 4/1956 | Martines | 339/258 |
| 3,590,387 | 6/1971 | Landis | 339/277 R |
| 3,810,074 | 5/1974 | Brandenburg, Jr. | 339/100 |
| 4,168,875 | 9/1979 | Leonard, Jr. et al. | 339/147 R |

FOREIGN PATENT DOCUMENTS

| | | | |
|---|---|---|---|
| 525624 | 1/1954 | Belgium | 339/26 |

*Primary Examiner*—Neil Abrams

*Attorney, Agent, or Firm*—F. J. Fodale

[57] ABSTRACT

A pigtail assembly is permanently attached to an oxygen sensor post terminal having longitudinally spaced ring contacts of different diameter. The pigtail assembly includes an end connector, a pair of insulated lead wires extending from the end connector, an appropriately sized terminal attached to the end of each insulated lead wire, and a splash guard slidably mounted on the insulated lead wires.

Each of the terminals has a clip-like contact shaped for snap assembly to, retention on, and welding to a respective one of the ring contacts. An insulator sleeve, slidably mounted on the lead wire having the smaller terminal attached to its end isolates the terminals from each other and properly positions the splash guard after the terminals are welded to the associated ring contacts of the oxygen sensor.

4 Claims, 3 Drawing Figures

PIGTAIL ASSEMBLY

This invention relates generally to electric connectors and more particularly to a pigtail assembly which has a plurality of terminals which are to be welded to respective contacts of a post terminal.

In our pending U.S. patent application Ser. No. 920,135 filed June 28, 1978, now U.S. Pat. No. 4,168,875 granted Sept. 25, 1979 we disclose a pigtail assembly which is permanently attached to an oxygen sensor post terminal. The pigtail assembly has four insulated lead wires, each having a flag terminal secured to one end. The four flag terminals are initially mounted in a welding fixture-connector body of dielectric material which isolates the flag terminals from each other and prearranges the flag terminals for assembly to a post terminal. After assembly, the welding fixture-connector body serves as a welding fixture while the flag terminals are welded to respective contacts of the post terminal. The connection is then protected by a splash guard slidably carried on the insulated lead wires.

In the arrangement described above, the juxtaposition of the flag terminals to the respective contacts of the post terminal during welding depends on the fit of the flag terminals in the welding fixture-connector body and the fit of the body on the post terminal. This arrangement, while suitable in some instances, is not accurate enough for sophisticated welding techniques, such as laser welding, which require a precisely located, intimate contact area between the parts to be welded to each other.

The object of this invention then is to provide a pigtail assembly having a plurality of terminals which are snap assembled to respective contacts of a post terminal and when snap assembled provide precisely located intimate contact areas between the terminals and their associated contacts for welding the parts together.

Yet another object of this invention is to provide a pigtail assembly having a plurality of terminals which are snap assembled and welded to respective contacts of a post terminal and a sleeve which electrically isolates the terminals from each other after the terminals are snap assembled and welded to their associated contacts of the post terminal.

Other objects and features of the invention will become apparent to those skilled in the art as the disclosure is made in the following detailed description of a preferred embodiment of the invention as illustrated in the accompanying sheet of drawing in which.

Figure 1:
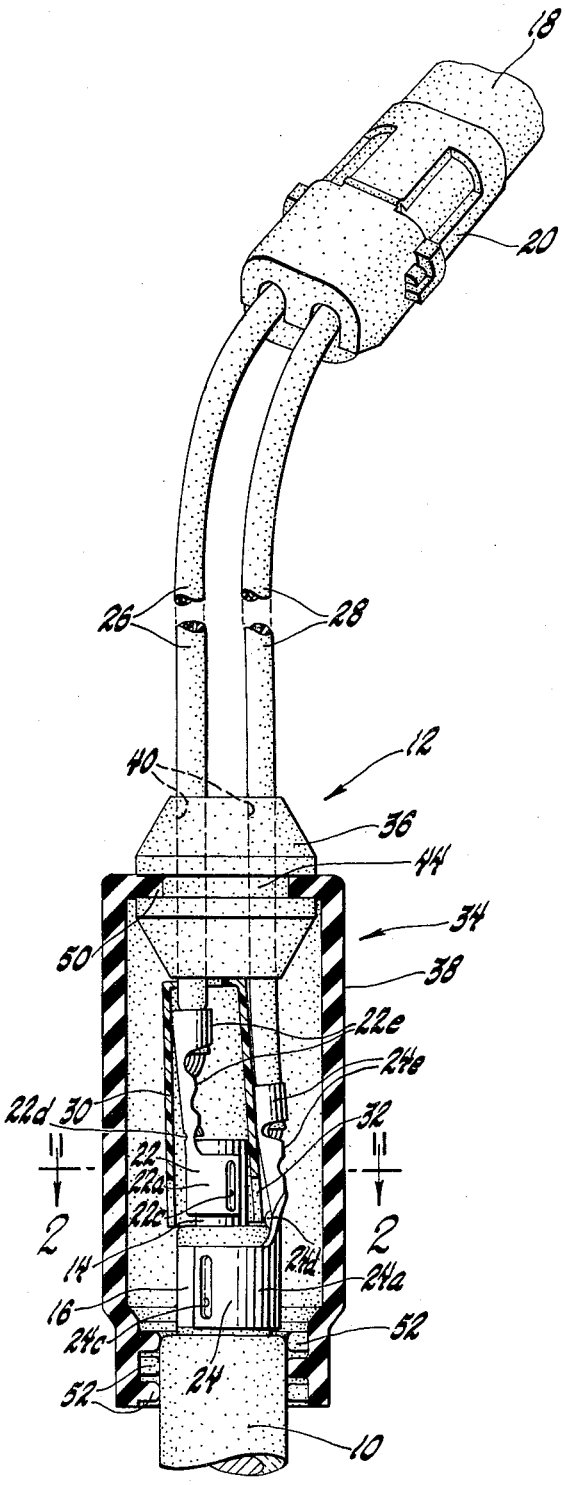
FIG. 1 is a partially sectioned, partially perspective, view showing a pigtail assembly embodying the invention attached to an oxygen sensor post terminal.
Figure 2:
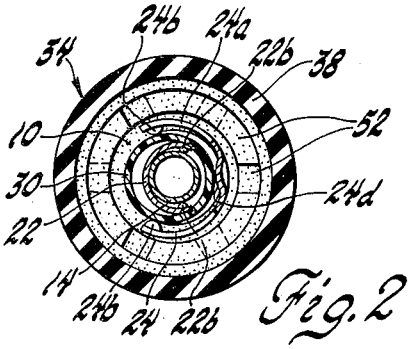
FIG. 2 is a section taken substantially along the line 2—2 of FIG. 1 and looking in the direction of the arrows.

Referring now to the drawing, and more particularly to FIG. 1, an oxygen sensor 10 is represented by its somewhat schematic post terminal portion to which is permanently attached a pigtail assembly 12. The oxygen sensor 10 is a device which is used to detect the amount of oxygen in the exhaust gases of an internal combustion engine or the like by means of an electrode which is exposed to the exhaust gases on one side and to ambient air on the other side. The electrode generates a signal representative of the relative concentrations of oxygen in the ambient air and exhaust gases. The generated signal in turn is used to control the fuel-air ratio of the combustible mixture for the internal combustion engine.

The oxygen sensor 10 has a post terminal which provides two concentric longitudinally spaced ring contacts 14 and 16 of different diameters. The smaller diameter contact 14 is in the form of a hollow protruding post which is electrically connected to the air side of the electrode (not shown) and which, being hollow, provides a passage for ambient air to reach the air side of the electrode. The larger diameter contact 16 is mounted on ceramic portions of the oxygen sensor 10 and electrically connected to the exhaust gas side of the electrode and ground (not shown).

The pigtail assembly 12 serves to connect the ring contacts 14 and 16 to an electric circuit via a suitable wiring harness represented by an end connector 18 which mates with a suitable end connector 20 of the pigtail assembly 12. Specific construction details of the end connector 20 and its mating connector 18 are not per se a part of this invention. However, pending U.S. patent application Ser. No. 953,410 filed Oct. 23, 1978 for a "Weatherproof Electrical Connector" discloses construction details of connectors which we have found useful for attaching a pigtail assembly to a wiring harness, particularly in the case of a pigtail assembly for an oxygen sensor.

The pigtail assembly 12 is attached to the oxygen sensor 10 by snap-on terminals 22 and 24 secured to the ends of the respective insulated lead wires 26 and 28 leading out of the end connector 20. These snap-on terminals 22 and 24 have the same contact characteristics but differ in size and wing construction, as will hereinafter more fully appear.

The snap-on terminal 22 has a clip-like contact **22*a* which is formed by a U-shaped channel having a longitudinal, internal rib 22*b* adjacent each longitudinal edge. The contact 22*a* is designed so that it expands over the ring contact 14 and snaps into a retained position where the contact 22*a* engages the ring contact 14 at each rib 22*b* and halfway between the ribs 22*b*. The engagement halfway between the ribs 22*b* provides a precisely located, intimate linear contact area which is used to weld the two contacts to each other. The ribs 22*b* are preferaby made by indents which provide corresponding grooves 22*c* in the outer surface of the contact 22*a*** which may be advantageously used as locators for aiming the welding apparatus.

The snap-on terminal 22 also has a dimple **22*d* at the base of the contact 22*a* which serves as a stop to properly position the contact 22*a* on the ring contact 14 in the longitudinal direction. The snap-on terminal 22 has a standard wing construction 22*e*, comprising core and insulation crimp wings, for attachment to the insulated lead wire 26. The core crimp wings are preferably slotted and the lead wire core is preferably laser welded to the snap-on terminal 22** at this location.

The snap-on terminal 24 also has a clip-like contact **24*a* which is formed by a U-shaped channel having longitudinal, inwardly projecting, ribs 24*b*. The contact 24*a* is larger than the contact 22*a* and is designed so that it expands over the larger ring contact 16 and snaps into a retained position where it engages the ring contact 16 at each internal rib 24*b* and halfway between the internal ribs 24*b*. As before, the engagement halfway between the ribs 24*b*** provides a precise intimate linear contact area for welding the two contacts to each other.

The ribs 24*b* are also preferably made by indents which provide corresponding grooves 24*c* in the outer surface of the contact 24*a* which may be used as locators for welding. The snap-on terminal 24 also has a dimple 24*d* at the base of the contact 24*a* which serves as a stop to properly position the contact 24*a* on the ring contact 16 in the longitudinal direction for attaching the snap-on terminal 24 to the insulated lead wire 28. The wing construction 24*e* is the same as the wing construction 22*e*. The orientation of the wing construction 24*e*, however, is opposite, that is, the core and insulation crimp wings project in a radial direction, opposite the radial projection of the contact 24*a*. This special orientation of the wing construction 24*e* permits an insulator sleeve 30 to be positioned over the terminal 22 as shown in FIG. 1 to isolate terminals 22 and 24 from each other after the terminals 22 and 24 are welded to the oxygen sensor 10. As before, the core crimp wings are preferably slotted and the snap-on terminal 24 is preferably laser welded to the lead wire core.

The snap-on terminal 22 engages the smaller diameter ring contact 14 which is in the form of a protruding post. Consequently the lead wire 26 carrying the snap-on terminal 22 is preferably slightly shorter than the lead wire 28 for the snap-on terminal 24 so that the length of the lead wires 26 and 28 are effectively equal when the snap-on terminals 22 and 24 are attached to the oxygen sensor 10.

The insulator sleeve 30 may be made of any suitable high temperature resistant, insulator material. An example of a suitable material is Ryton, a phenolic thermoplastic material produced by Phillips Chemical Co. The insulator sleeve 30 is slidably mounted on the insulated lead wire 26 and, as indicated above, fits over the snap-on terminal 22 as shown in FIG. 1. The lower end of the insulator sleeve 30 has a pair of diametrically opposed slots 32. The slots 32 provide a vent through which ambient air reaches the hollow post or ring contact 14 when the insulator sleeve 30 is in the position shown in FIG. 1.

The height of the insulator sleeve 30 is preferably such that, when in the position shown in FIG. 1, the insulator sleeve 30 serves as a stop to properly position a splash guard 34. The splash guard 34 is generally the same as that disclosed in our aforementioned pending U.S. patent application Ser. No. 920,135. As before, the splash guard 34 comprises a grommet 36 and a boot 38 of silicone material. The grommet 36 has two round passages 40 and assembly slits 42 for slidably mounting the grommet 36 on the insulated lead wires 26 and 28. The grommet 36 also has a circumferential groove 44 which receives and seals an inturned flange 50 at one end of the boot 38. The other end of the boot 38 has sealing ribs 52 which engage the oxygen sensor 10 below the ring contact 16. The sealing ribs 52 are interrupted at different locations to provide an indirect vent path to the interior of the boot. The grommet 36 is assembled on the insulated lead wires 26 and 28 so that the insulator sleeve 30 is slidably mounted on the insulated lead wire 26 between the grommet 36 and the snap-on terminal 22.

Figure 3:
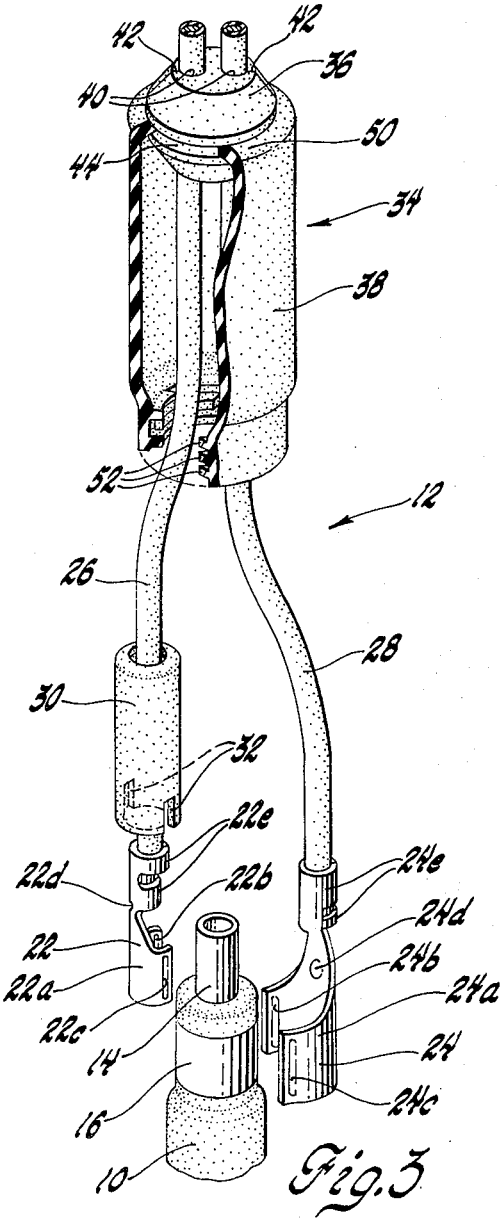
FIG. 3 is a partially sectioned, partially perspective view showing the pigtail assembly of FIG. 1 in the process of being attached to the post terminal.

The insulator sleeve 30, grommet 36, and boot 38 are in raised non-interfering positions while the snap-on terminals 22 and 24 are attached to the oxygen sensor 10 as shown in FIG. 3. After the terminals 22 and 24 are snapped onto the respective ring contacts 14 and 16, the terminals 22 and 24 are permanently secured to the oxygen sensor 10, preferably by laser welding. The insulator sleeve 30 is then slid over the snap-on terminal 22 and ring contact 14 to which it is welded. This isolates the snap-on terminals 22 and 24 from each other to prevent shorting across the terminals. The splash guard 34 is then lowered into the sealing position shown in FIG. 1 to protect the electrical connections made by the terminals 22 and 24 from dirt, water and other deleterious environmental matter.

We wish it to be understood that we do not desire to be limited to the exact details of construction shown and described, for obvious modifications will occur to a person skilled in the art.

The embodiments of the invention in which an exclusive property or privilege is claimed are defined as follows:

1. In a pigtail assembly adapted for attachment to a post terminal having longitudinally spaced ring contacts which includes an end connector having a plurality of insulated lead wires extending therefrom and a terminal attached to the end of each insulated lead wire, the improvement comprising:

each of said terminals having a clip-like contact shaped for assembly to and retention on a respective one of the ring contacts, and one of the insulated lead wires having an insulator sleeve slidably mounted thereon between the end connector and the terminal attached to its end, said insulator sleeve being slidable to a position over the terminal attached to the one lead wire and juxtaposed a portion of each remaining terminal for isolating the terminal attached to the one lead from each remaining terminal.

2. In a pigtail assembly adapted for attachment to a post terminal having longitudinally spaced ring contacts which includes an end connector having a plurality of insulated lead wires extending therefrom and a terminal attached to the end of each insulated lead wire, the improvement comprising:

each of said terminals having a clip-like contact shaped for lateral snap assembly to and retention on a respective one of the ring contacts, each said contact being in the form of a U-shaped channel having an internal rib adjacent each longitudinal edge and sized to engage its associated ring contact at each internal rib and at a location halfway therebetween, one of the insulated lead wires having an insulator sleeve slidably mounted thereon between the end connector and the terminal attached to its end, said insulator sleeve being slidable to a position over the terminal attached to the one lead wire for isolating the aforesaid terminal from each remaining terminal.

3. In a pigtail assembly adapted for attachment to a post terminal having longitudinally spaced ring contacts which includes an end connector having a plurality of insulated lead wires extending therefrom, a terminal attached to the end of each insulated lead wire and a splash guard slidably mounted on the insulated lead wires, the improvement comprising:

each of said terminals having a clip-like contact shaped for assembly and retention on a respective one of the ring contacts with a precise intimate linear contact area therebetween for welding the contacts to each other and one of the insulated lead wires having an insulator sleeve slidably mounted thereon between the splash guard and the terminal attached to its end, said insulator sleeve being slidable to a position over the terminal attached to the end of the one lead wire for isolating the aforesaid terminal from each remaining terminal when the terminals are attached to respective ones of the ring contacts, said insulator sleeve being of a predetermined height so that when in the aforesaid position, it provides a stop for properly positioning the splash guard slidably mounted on the insulated lead wires.

4. In a pigtail assembly adapted for attachment to a post terminal having a pair of longitudinally spaced concentric ring contacts of different diameter, which pigtail assembly includes an end connector, a pair of insulated lead wires extending from the end connector, and a terminal attached to the end of each insulated lead wire, the improvement comprising:

one of said insulated lead wires having an insulator sleeve slidably mounted thereon and a terminal at its end which has a smaller clip-like contact shaped for lateral snap assembly and retention on the smaller one of the ring contacts, the other of said insulated lead wires having a terminal at its end which has a larger clip-like contact shaped for lateral snap assembly and retention on the larger one of the ring contacts, each of the clip-like contacts being in the form of a U-shaped channel having an internal rib adjacent each longitudinal edge and sized to engage its associated ring contact at each internal rib end at a location halfway therebetween, said insulator sleeve being slidable to a position over the terminal having the smaller clip-like contact when it is attached to the smaller ring contact for isolating the terminals from each other, the terminal having the larger clip-like contact having crimp wings securing it to the other said insulated lead wire which crimp wings project in a radial direction opposite the radial projection of the larger clip-like contact to accommodate the insulator sleeve in a position over the terminal having the smaller clip-like contact when the terminals are attached to the associated ring contacts.

* * * * *